US006386188B1

(12) United States Patent
Bender

(10) Patent No.: US 6,386,188 B1
(45) Date of Patent: May 14, 2002

(54) EXHAUST GAS RECIRCULATION VALVE

(75) Inventor: Franz Bender, Wendlingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/591,767

(22) Filed: Jun. 12, 2000

(30) Foreign Application Priority Data

Jun. 29, 1999 (DE) ..... 199 29 956

(51) Int. Cl.[7] ..... F02M 25/07

(52) U.S. Cl. ..... 123/568.12; 123/568.17; 123/568.18

(58) Field of Search ..... 123/568.11, 568.12, 123/568.13, 568.17, 568.18

(56) References Cited

U.S. PATENT DOCUMENTS 4,329,965 A * 5/1982 Ueda et al. ..... 123/568.18
4,635,609 A * 1/1987 Seppen et al. ..... 123/568.17
5,746,190 A * 5/1998 Honda ..... 123/568.18
5,931,131 A * 8/1999 Hackett ..... 123/568.12
5,979,421 A * 11/1999 Yamashita et al. ..... 123/568.12
6,044,827 A * 4/2000 Pfaff et al. ..... 123/568.18

FOREIGN PATENT DOCUMENTS

| | | |
|---|---|---|
| DE | 197 25 668 | 10/1998 |
| DE | 19744936 | 4/1999 |
| EP | 0 080 327 | 6/1983 |
| EP | 0 622 533 | 11/1994 |
| JP | 04 175453 | 6/1992 |
| JP | 11 082184 | 3/1999 |

* cited by examiner

*Primary Examiner*—Willis R. Wolfe
(74) *Attorney, Agent, or Firm*—Klaus J. Bach

(57) ABSTRACT

In an internal combustion engine having an air intake system and an exhaust outlet system, and an exhaust gas recirculation system which has an exhaust-gas recirculation line and an exhaust-gas recirculation valve for supplying a controlled quantity of exhaust gas to the air intake system, the recirculation valve is separated from the apparatus which introduces the exhaust gas into the air intake so that it is exposed only to exhaust gas and not to the air intake flow.

12 Claims, 3 Drawing Sheets

EXHAUST GAS RECIRCULATION VALVE

BACKGROUND OF THE INVENTION

1. Field of the Invention

This invention relates to an exhaust gas recirculation apparatus and system for an internal combustion engine which has an air intake system and an exhaust system. Exhaust gas is introduced to fresh air in the air intake via an exhaust-gas recirculation line and an exhaust-gas recirculation valve.

2. Description of Related Art

Exhaust gas recirculation apparatus and systems for an internal combustion engines are known. It is also known that part-load engine operation produces cooling of the exhaust gases and the recirculation valve in previous systems. During part-load operation under particular temperatures, a lacquer-like coating can form on the exhaust gas recirculation valve which could inhibit its operation.

SUMMARY OF THE INVENTION

The primary object of the invention is to design and configure the exhaust gas recirculation system so that formation of lacquer-like substances are prevented from forming on the recirculation valve or valve seat.

According to the invention, the object of preventing formation of a lacquer-like substance is achieved by arranging the exhaust gas recirculation valve so as not to be exposed to air intake flow. This tends to prevent cooling of the recirculation valve by contact with the flow of fresh air. As a result, the recirculation valve does not come into contact with crankcase oil entrained in the flow of intake air. The exhaust-gas recirculation valve may be located at any desired point between the cylinder head and exhaust-gas supply device. By separating the exhaust gas recirculation valve from crankcase ventilation oil entrained in the intake air prevents clogging of the valve caused by formation of a soot/oil mixture on the valve and valve seat.

In accordance with a preferred embodiment of the invention, the exhaust gas recirculation valve includes an actuator and the actuator in the recirculation valve is operated electromechanically. The electromechanical actuator is seated directly on the exhaust-gas recirculation valve and is activated via the engine cable harness.

It is particularly important for the present invention that the exhaust-gas recirculation valve is operatively connected to the cooling means or coolant flow in the engine's cylinder head. As a result, if required as it is in the full-load operational engine mode, the exhaust gas can be cooled which also cools the recirculation valve. Consequently, the electromechanical actuator of the recirculation valve is protected from excessive temperatures.

In connection with the design and arrangement according to the invention, it is advantageous that the exhaust-gas recirculation valve and the exhaust-gas supply means are arranged on the cooler side. of the cylinder head as determined by the coolant flow through the engine.

It is advantageous, furthermore, if the exhaust gas recirculation line has a portion integrated with the cylinder head and an external portion.

It is also advantageous, if the engine exhaust gas system and the exhaust gas recirculation valve are operatively connected via an integrated exhaust-gas recirculation passage. The integrated exhaust-gas recirculation passage is designed as a part of the cylinder head. The exhaust gas line transfers heat through its wall to the cylinder head and/or to coolant in the cylinder head.

However, it is also possible for the exhaust-gas recirculation valve and exhaust-gas supply means to be operatively connected via an external exhaust-gas recirculation line. The external exhaust-gas recirculation line is preferably designed as a combination pipe including an exhaust-gas passage and a cooling-water passage. The cooling-water passage is in communication with the cooling-water circuit of the cylinder head via the exhaust-gas recirculation valve. The distance between the exhaust-gas recirculation valve and the cylinder head and the associated exhaust-gas temperature may be varied.

In a further refinement of the invention, the inflow orifice for fresh air is connected to the charge-air line, the inflow orifice for exhaust gas is connected to the external exhaust-gas recirculation line, the outflow orifice for fresh air to the charge-air distributor and the outflow orifices for exhaust gas likewise are connected to the charge-air distributor. The exhaust-gas stream is thus mixed with the fresh-air stream. After the exhaust gas flows is introduced centrally into the fresh-air stream, the process of mixing the two gas streams commences. During this time, no appreciable soot/oil deposits occur in the region of the exhaust-gas supply means, and clogging is prevented.

In connection with the arrangement according to the invention, it is advantageous that the exhaust-gas recirculation valve is provided directly upstream of the exhaust-gas supply means, as seen in the direction of flow. The exhaust-gas recirculation valve and exhaust-gas supply means are arranged functionally in one housing and being flow-connected via the inflow orifice for exhaust gas. The functional separation of exhaust-gas recirculation valve and exhaust-gas supply means ensures that the exhaust-gas recirculation valve does not have the fresh-air stream flowing around it and therefore is not cooled by the air.

BRIEF DESCRIPTION OF THE DRAWINGS

Further advantages and details of the invention are explained in the description of an embodiment which is illustrated in the drawing figures, as follows.

DESCRIPTION OF A PREFERRED EMBODIMENT

Figure 1:
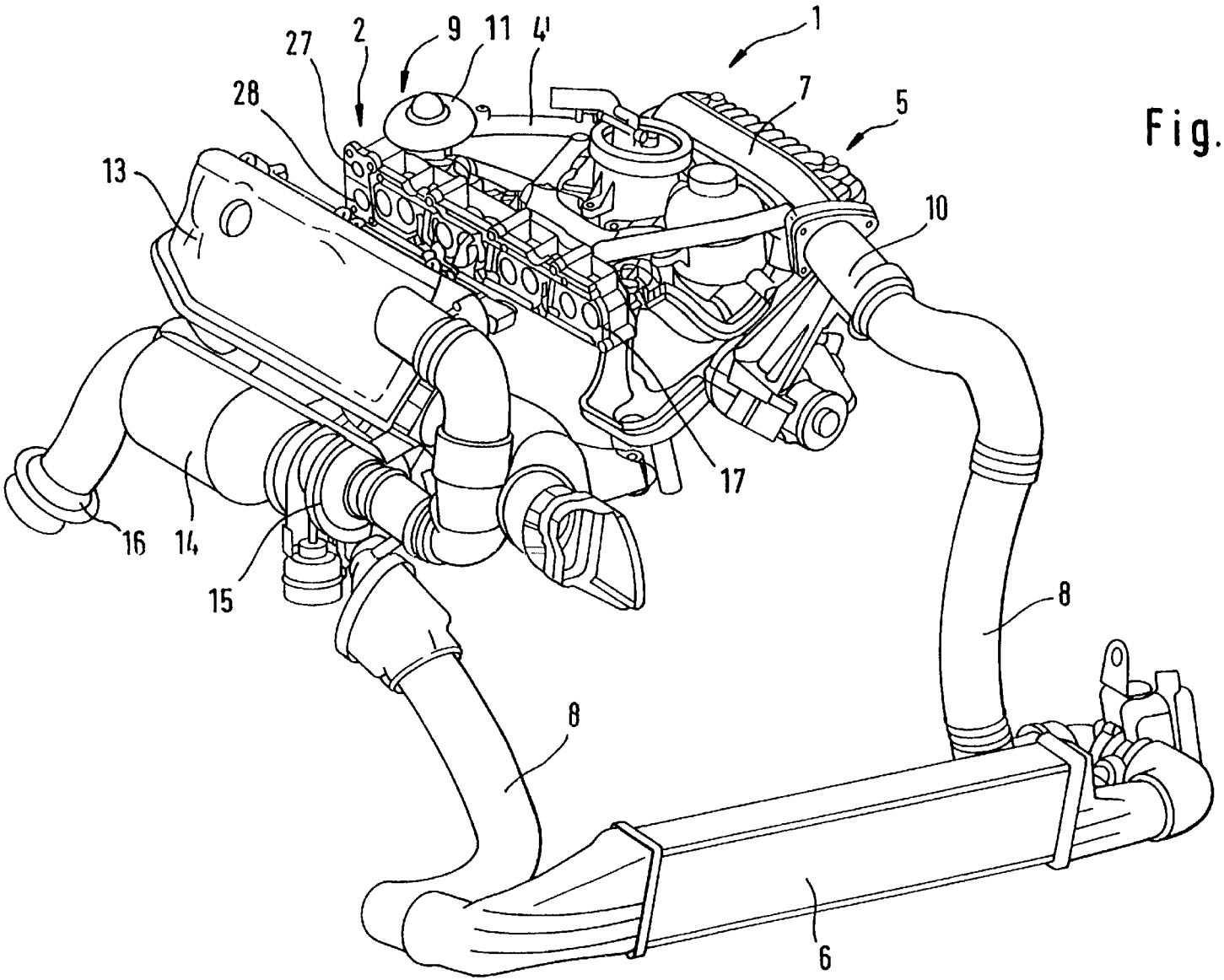
FIG. 1 is a perspective illustration of the air intake and exhaust outlet assemblies for an internal combustion engine.

FIG. 1 shows an air inlet or intake assembly 1 for an internal combustion engine. The air intake assembly 1 is adapted to be supported by an engine cylinder head. The air intake assembly 1 has an air-charge manifold forming portion 2 positioned to direct air flow into individual cylinders of the engine. The assembly 1 also includes a charge-air distribution portion 7 upstream of the outlet forming portion 2 for receiving air from an elongated charge-air supply assembly 8.

The intake assembly 1 and particularly the manifold forming portion 2 and distribution portion 7 are associated with an exhaust-gas recirculation system 5 for the purpose of directing controlled quantities of exhaust gas into the engine's combustion chambers along with the air flow provided by the intake system 1 during selected operational modes of the engine for limiting the combustion temperature.

An air filter assembly 13 is located upstream of the elongated charge-air supply assembly 8. The outlet of the air filter assembly 13 is fluidly connected to an inlet of a supercharger device 15. In FIG. 1, the supercharger 15 is of the type commonly known as a turbocharger because the motive power to pressurise and pump air is provided by engine exhaust energy. The supercharger of turbocharger 15 has an air compressor portion and an exhaust gas turbine portion which are interconnected for rotation together. Air is fed from the air filter 13 to the inlet of the compressor portion of the supercharger. Pressurized and heated air is then discharged into the inlet end portion of the charge-air line 8. The charge-air line 8 extends from the supercharger to the engine's air intake assembly 1 and has a charge-air cooler 6 which transfers heat from the supercharger's pressurized air to the atmosphere.

FIG. 1 also shows portions of the engine's gas exhaust system which includes the gas turbine portion of the supercharger and a catalytic converter 14. The exhaust system then includes a tubular section 16 extending from the catalytic converter's outlet to a sound muffling system (not shown).

Between the air-charge line 8 and the charge-air manifold 7 is an exhaust gas introduction or supply device 10. The exhaust gas supply device 10 is connected via an external conduit part 4' to an exhaust-gas recirculation control valve 9. The recirculation control valve 9 is itself connected to the exhaust system of the engine via a fluid conducting means 4 best understood by looking to FIG. 2. Functionally, exhaust gas is introduced or supplied through device 10 to the intake air for the engine which flows to individual cylinders through inlet duct openings 17.

Fresh air is drawn in through the air filter assembly 13 and is pressurised by the compressor portion of the supercharger 15. The compressor portion of the supercharger 15 is driven by the energy of the outflowing exhaust gases which are discharged from the combustion chambers of the engine to the turbine portion of the supercharger.

The process of pressurizing the air also heats it. The heated air is then cooled by the charge-air cooler 6 before passing into the charge-air manifold 7. The exhaust gas supply device 10 introduces a controlled quantity of exhaust gas under control of the recirculation valve 9 to the fresh air passing through the intake assembly 1. The exhaust gas is mixed with the compressed air downstream of the recirculation valve 9.

Figure 2:
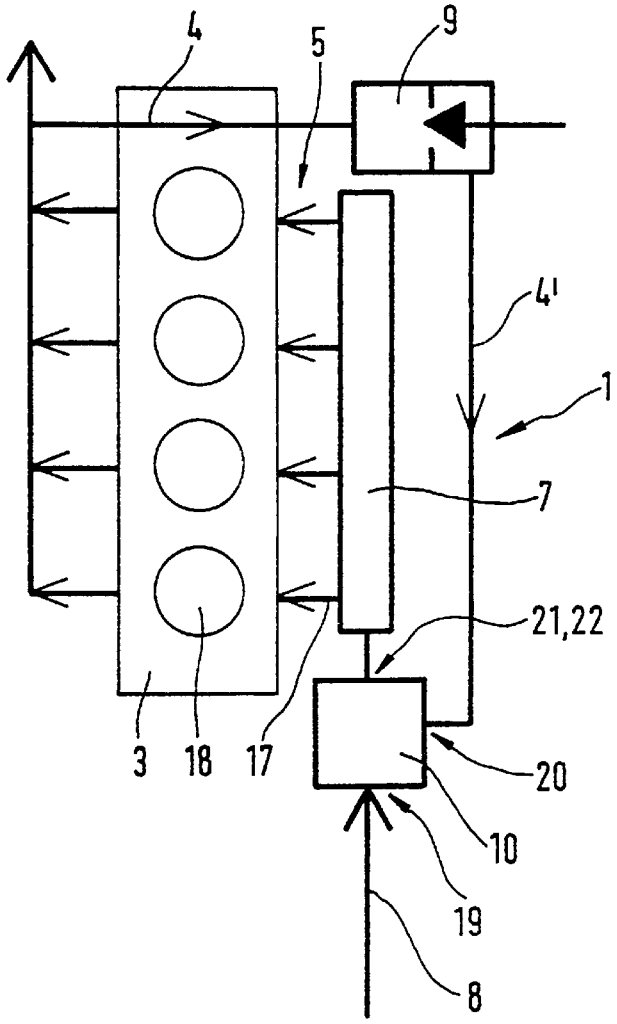
FIG. 2 is a diagrammatic and planar illustration of the engine and associated intake, exhaust, and exhaust gas recirculation systems according to FIG. 1.
Figure 3:
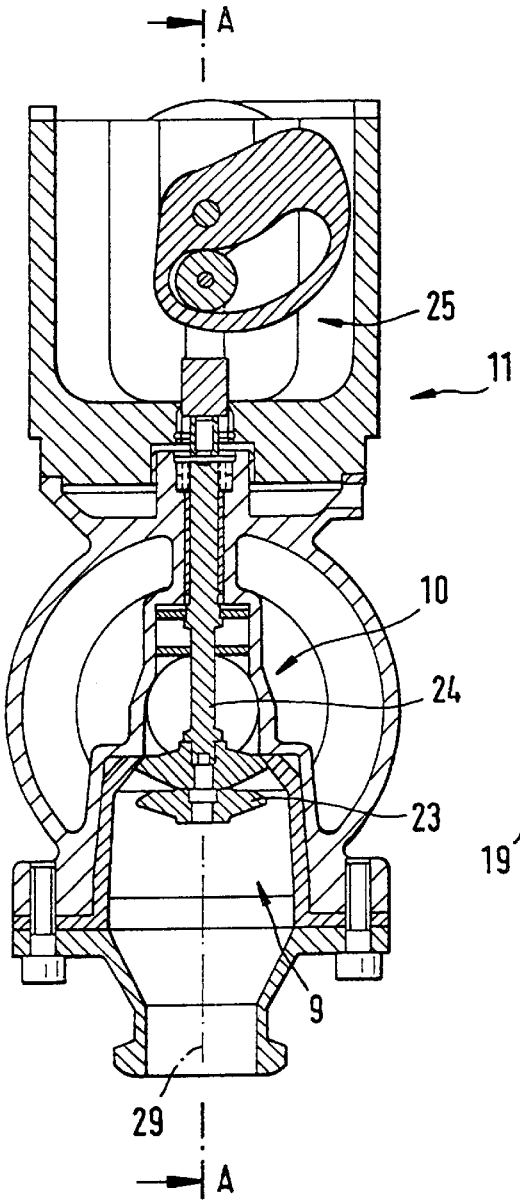
FIG. 3 is an elevational and sectioned view of an integrated exhaust gas recirculation valve assembly and an exhaust-gas supply assembly as taken along section line B—B in FIG. 4.
Figure 4:
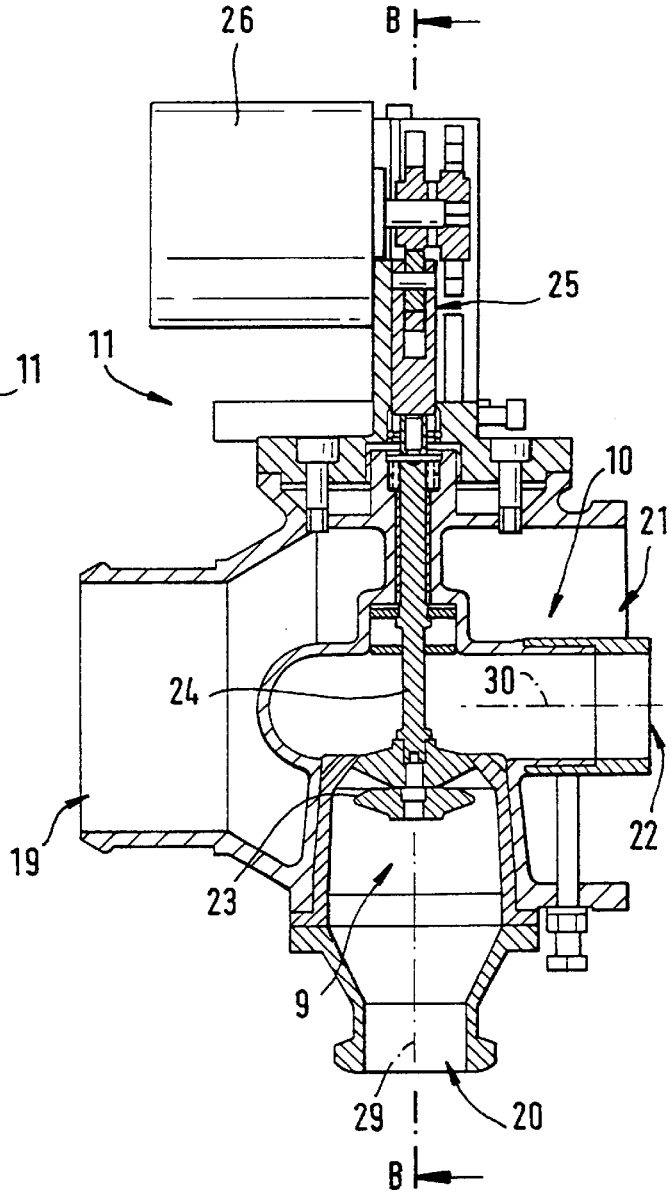
FIG. 4 is an elevational and sectioned view of the integrated exhaust gas recirculation valve assembly and exhaust-gas supply assembly as taken along section line A—A in FIG. 3.

The exhaust gas recirculation valve 9 regulates the quantity of exhaust gas entering the air intake system 1 and its operation is controlled by an actuator device 11 which is best seen in FIGS. 3 and 4. As a result, a quantity of exhaust gas is introduced to the fresh air so that a homogeneous fresh-air/exhaust gas mixture is obtained in the charge-air manifold 7. This homogeneous fresh air/exhaust gas mixture is supplied via the individual inlet ducts 17 to cylinders 18 of the engine as seen in FIG. 2.

FIG. 2 shows the integrated exhaust gas conducting part or portion 4 of the exhaust-gas recirculation line which passes through the engine's cylinder head. Part 4 extends from the engine's exhaust system to the inlet of the exhaust gas recirculation valve 9. During passage through the cylinder head 3, the exhaust gas discharges heat to coolant in the cylinder head.

The exhaust gas conducting portion can include an arrangement using two passages 27, 28, as shown in FIG. 1 wherein the passage 28 connects to the cooling water circuit of the cylinder head and the passage 27 serves as part of the exhaust-gas recirculation line. A further valve, not illustrated, can be provided for regulating the flow of cooling water for this portion of the exhaust gas recirculation system. By this means, a desired regulation of the exhaust gas temperature can be achieved.

In FIG. 2, the flow arrangement between the exhaust gas recirculation valve 9 and exhaust-gas supply device 10 is diagrammatically shown in conjunction with the engine's air inlet assembly. It is advantageous that the exhaust-gas recirculation valve 9 and exhaust-gas supply means 10 are separated so that the recirculation valve is not exposed to flow of intake air. It is possible to both position the recirculation valve 9 at an end of the recirculation line's external part 4' and to have the recirculation valve and exhaust gas supply means 10 in a common enclosure or housing. By this, the recirculation valve 9 is still exposed only to the exhaust gas stream and not cooled by the fresh air stream.

The recirculation valve 9 is preferably positioned adjacent to a cooler end of the cylinder head 3 and is supplied with exhaust gas via the integrated part 4 of the exhaust-gas recirculation line. The exhaust-gas supply device 10 is located upstream of the charge-air distributor 7 and is furnished with exhaust gas from the recirculation valve 9 via external part 4'.

As previously explained, the exhaust-gas recirculation line's internal part 4 can be operatively associated with the engine's cooling-water circuit. Thereby, the operating temperature of the exhaust gas passing to the recirculation valve 9 can be regulated or controlled. This control provides a protection against overheating and/or overcooling which tends to generate formation of a lacquer-like substance on part of the exhaust-gas recirculation valve 9.

FIGS. 3 and 4 are each sectional views of the exhaust-gas recirculation valve 9 including an integrated exhaust-gas supply assembly 10. The recirculation valve 9 includes a radially enlarged valve body 23, a valve actuating shaft 24, a valve actuating mechanism 25, and an actuator in the form of an electrically powered servomotor 26. The members 23, 24, and 25 are arranged coaxially with respect to axis 29.

The valve actuating shaft 24 and valve body 23 are moved vertically between fully closed and opened operative positions by rotation of servomotor 26. Servomotor 26 in turn rotates the actuating member 25 which is configured to function as a cam member. In this embodiment, the valve body 23 is self-locking in both end positions. This means that in the closed position or mode, the prevailing exhaust gas pressure tends to maintains the valve in the closed position. In the opened position or mode, the cam arrangement tends to prevent imposition of force on the servomotor 26.

In FIG. 4, it can be seen that fresh air enters the exhaust gas supply device 10 from the left through an inlet 19. Exhaust gas enters the exhaust gas supply device 10 from the bottom through an inlet 20. The exhaust gas then flows through a valved outflow orifice assembly 22 including an exhaust gas conduit having axis 30. The exhaust begins to mix with the flow of fresh air downstream of valve 23 as they exit outlets 21, 22 respectively as the flow enters the charge-air manifold 7.

Figure 5:
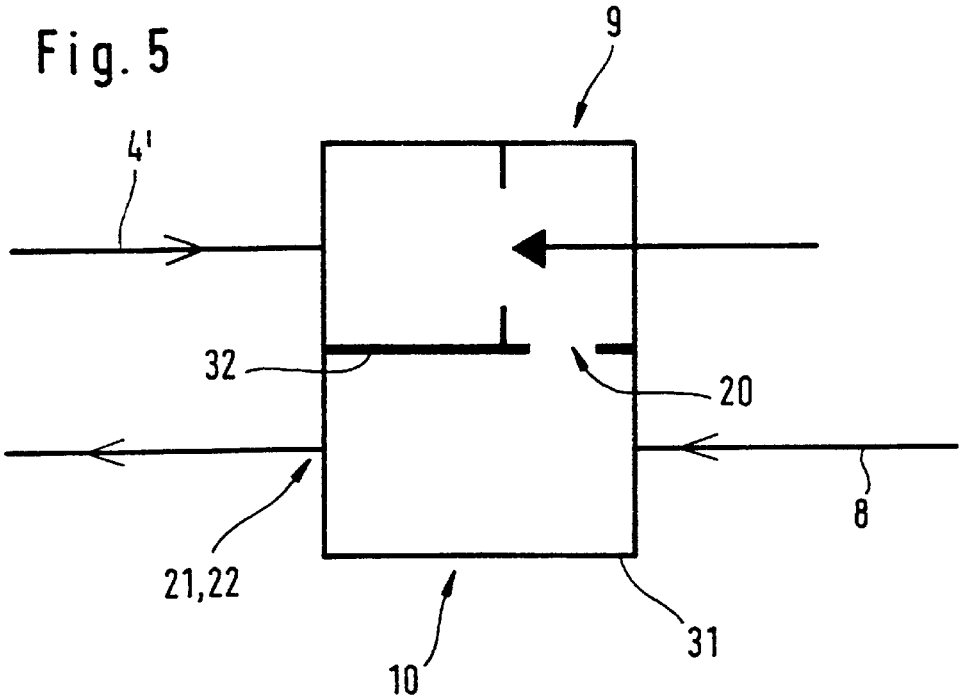
FIG. 5 is a diagrammatic view showing the flow through the integrated exhaust gas recirculation valve and the exhaust gas supply assembly.

FIG. 5 illustrates an integrated assembly with a housing 31 enclosing the exhaust gas recirculation valve 9 and the gas supply device 10. The housing 31 includes an internal wall 32 separating the portion of the housing enclosing the exhaust gas recirculation valve 9 and the portion of the housing enclosing the supply device 10 which provides for flow of fresh air. As a result, the recirculation valve 23 is not cooled by a flow of fresh air. This inhibits formation of lacquer-like substances on the valve and valve seat. The exhaust gas enters the housing enclosure 31 via the inlet orifice 20 in the separating wall 32. Fresh air enters the housing enclosure 31 via the inlet orifice 19 shown in FIG. 4. The resultant mixture of air and exhaust gas flows separately into the charge-air distributor via the outlet orifices 21 and 22.

I claim:

1. An exhaust gas recirculation system for an internal combustion engine having an air inlet system with a charge-air line and an exhaust gas outlet system comprising: an exhaust gas recirculation line; an exhaust-gas recirculation valve within the recirculation line; the exhaust gas recirculation line being operatively connected to the exhaust gas outlet system for receiving exhaust gas; an exhaust gas supply means for receiving exhaust gas from the recirculation valve and functioning as a mixing device to introduce exhaust gas to the flow of air intake; the supply means associated with an external part of the exhaust gas recirculation line separate from the recirculation valve.

2. The exhaust gas recirculation system according to claim 1 in which the exhaust gas recirculation valve and exhaust gas supply means are operatively connected by the external part of the exhaust-gas recirculation line.

3. The exhaust gas recirculation system according to claim 2, in which the external part of the exhaust gas recirculation line is operably connected to the exhaust gas outflow orifice and the fresh air outflow orifice is connected to the charge-air distributor.

4. The exhaust gas recirculation system according to claim 1, and an engine cylinder head through which engine coolant flows and the feed of exhaust gas to the exhaust-gas recirculation valve is routed in heat exchange relationship through the cylinder head.

5. The exhaust gas recirculation system according to claim 4, in which the coolant flow through the cylinder head has a relatively cool inlet region and the exhaust gas recirculation valve and exhaust gas supply means are positioned adjacent this cooler inlet region of the cylinder head.

6. The exhaust gas recirculation system according to claim 4, in which a portion of the exhaust gas recirculation line used to route exhaust gas to the recirculation valve includes a passage means in the cylinder head.

7. The exhaust gas recirculation system according to claim 1 in which a charge-air distributor is positioned downstream of the exhaust-gas recirculation valve and the exhaust gas supply means in the direction of flow.

8. The exhaust gas recirculation system according to claim 7 in which the exhaust gas supply means includes two inflow orifices for receiving fresh air and exhaust gas respectively and includes two outflow orifices for discharging fresh air and exhaust gas into the charge-air distributor, the outflow orifice for routing exhaust gas being arranged centrally in the other outflow orifice for routing fresh air.

9. The exhaust gas recirculation system according to claim 8 in which one housing encloses both the exhaust gas recirculation valve and the exhaust gas supply means with separation means separating the fresh air flow and exhaust flow.

10. The exhaust gas recirculation system according to claim 7, in which a selectively operated an actuator controls opening and closing of the exhaust-gas recirculation valve.

11. The exhaust gas recirculation system according to claim 10, in which the actuator in the exhaust gas recirculation valve is an electromechanical device.

12. The exhaust gas recirculation system according to claim 10, in which the actuator in the exhaust gas recirculation valve is a pneumatic powered device.

* * * * *